US005937696A

United States Patent [19]

Ohya et al.

[11] Patent Number: 5,937,696

[45] Date of Patent: Aug. 17, 1999

[54] STARTER FOR AN INTERNAL COMBUSTION ENGINE

[75] Inventors: Masaaki Ohya, Isesaki; Koji Nara, Maebashi; Michio Okada, Gunma; Yoshikazu Sato, Fukaya; Shinichi Nagashima, Ashikaga, all of Japan

[73] Assignee: Mitsuba Corporation, Gunma-ken, Japan

[21] Appl. No.: 09/047,112

[22] Filed: Mar. 24, 1998

[30] Foreign Application Priority Data

Mar. 25, 1997 [JP] Japan ..... 9-072074

[51] Int. Cl.[6] ..... F02N 15/06

[52] U.S. Cl. ..... 74/7 A; 74/7 E; 74/526; 290/38 R; 290/48

[58] Field of Search ..... 74/7 A, 7 E, 526; 290/38 R, 48

[56] References Cited

U.S. PATENT DOCUMENTS

| | | | |
|---|---|---|---|
| 5,760,487 | 6/1998 | Kimura et al. | 290/48 |
| 5,839,313 | 11/1998 | Kimura et al. | 74/7 R |
| 5,844,336 | 12/1998 | Ohya et al. | 74/6 |

FOREIGN PATENT DOCUMENTS 8-319926 12/1996 Japan .

*Primary Examiner*—Allan D. Hermann
*Attorney, Agent, or Firm*—Marshall & Melhorn

[57] ABSTRACT

In an engine starter according to the present invention, an annular stopper disposed between the pinion unit and the solenoid device so as to determine the rest position of the pinion unit is formed with a tongue projecting radially outwardly from its outer periphery, and a shoulder surface defined in the gear cover so as to abut an end surface of the solenoid device and thereby determine the axial position of the solenoid device is formed with a recess for receiving the tongue of the annular stopper, with the tongue and the recess being dimensioned with respect to each other so as to allow the tongue to be resiliently interposed between the recessed part of the shoulder surface and the end surface of the solenoid device and to define a space which accommodates a corresponding deformation of the tongue. Thus, since a space which accommodates the deformation of the tongue of the stopper is provided within the recess of the shoulder surface, the tongue can be resiliently deformed so as to support the annular stopper steadily without affecting the axial position of the solenoid device.

5 Claims, 5 Drawing Sheets

STARTER FOR AN INTERNAL COMBUSTION ENGINE

TECHNICAL FIELD

The present invention relates to a starter for an internal combustion engine, and in particular to an engine starter in which the rotor shaft of the electric motor, the output shaft on which the pinion is mounted in an axially slidable manner, and the solenoid device for driving the pinion as well as a switch unit are disposed in a coaxial relationship.

BACKGROUND OF THE INVENTION

In conventional engine starters, it has been customary to arrange the output shaft, which carries an axially slidable pinion adapted to mesh with a ring gear, and the solenoid device for axially driving the pinion, in a mutually parallel relationship. However, because such bi-axial engine starters have a solenoid device which extends radially from the electric motor, and therefore inevitably have a substantial radial dimension, there have been severe restrictions in ensuring a sufficient space for mounting the engine starter.

To overcome such a problem, it has been proposed to provide a coaxial starter having an annular solenoid device surrounding the output shaft (see for example Japanese Patent Application Laid-Open Publication No. 8-319926 filed by the same applicant).

In such a coaxial type engine starter, the solenoid device is disposed between the pinion and the DC electric motor so that when activated, it moves the pinion axially into mesh with the ring gear of the engine. The pinion is always urged by a return spring or the like in a direction away from the ring gear of the engine so that when the solenoid device is deactivated the pinion is disengaged from the ring gear. In order to define the rest position of the pinion (or the position when the pinion is not moved by the activated solenoid device) against the force of the return spring, an annular stopper usually made of resin material is mounted at a position between the solenoid device and the pinion. Preferably, this stopper is secured not only in the axial direction but also in the rotational direction and connected to the solenoid device so that the stopper also serves to secure the solenoid device in the rotational direction.

The engine starter comprises a gear cover for accommodating the pinion, solenoid device and other component parts. This gear cover typically has a substantially cylindrical inner surface, and comprises a smaller diameter part for accommodating the pinion and a larger diameter part for accommodating the solenoid device, with an annular shoulder surface formed at the boundary between the smaller and larger diameter parts. In mounting the solenoid device in the gear cover, the solenoid device is forced into the larger diameter part of the gear cover until its end surface abuts the shoulder surface defined in the gear cover. In this way, the shoulder surface in the gear cover determines the axial position of the solenoid device.

In order to favorably dispose the stopper between the solenoid device and the pinion, the stopper is formed with a plurality of tongues projecting radially outwardly from its outer periphery, and the shoulder surface in the gear cover is formed with corresponding recesses for accommodating the tongues, so that each of the tongues of the stopper can be fixedly held between the corresponding recessed part of the shoulder surface and the end surface of the solenoid device.

However, if the tongues are too thin, the stopper cannot be steadily mounted. On the other hand, if the tongues are too thick, although the stopper can be steadily mounted, such tongues may prevent the solenoid device from abutting the shoulder surface in the gear cover. In such a case, the axial position of the solenoid device is varied depending on the thickness of the tongues, resulting in variation in the armature's stroke which in turn may create problems such as insufficient thrust force applied to the pinion or failure to achieve a required motion of a moveable contact plate of the switch unit which is operated in connection with the armature so as to selectively supply electric power to the motor. Although the stopper is typically made of resin material, deformation of the tongues of the stopper has been limited and insufficient to absorb deviation in size of the tongues from the standard one, because in order to secure the stopper in the rotational direction, the tongues have been designed so as to fit in their corresponding recesses, leaving little space therebetween to accommodate enough deformation of the tongues.

BRIEF SUMMARY OF THE INVENTION

In view of such problems of the prior art, a primary object of the present invention is to provide a coaxial type starter for an internal combustion engine, in which the stopper for determining the rest position of the pinion can be steadily mounted in the gear cover without affecting the axial position of the solenoid device.

A second object of the present invention is to provide such an engine starter, in which the stopper is rotationally secured in the gear cover.

A third object of the present invention is to provide such an engine starter without significantly increasing the manufacturing cost.

According to the present invention, these and other objects can be accomplished by providing a starter for an internal combustion engine, comprising: a DC electric motor; an output shaft driven by the DC electric motor; a pinion unit connected to the output shaft via a spline and moved axially between a rest position and an operative position in which the pinion unit meshes with a ring gear of the engine; a solenoid device for axially moving the pinion unit from its rest position to its operative position, the solenoid device disposed between the pinion unit and the DC electric motor and surrounding the output shaft, and the solenoid device having a first end surface facing the pinion unit and a second end surface facing the DC electric motor; a cover member having a substantially cylindrical inner surface for surrounding at least the pinion unit and the solenoid device, the cover member comprising a first part having a first inner diameter and accommodating the pinion unit and a second part having a second inner diameter which is larger than the first inner diameter and accommodating the solenoid device, with an annular shoulder surface defined at a boundary between the first and second parts, the shoulder surface abutting the first end surface of the solenoid device to determine an axial position of the solenoid device; and an annular stopper disposed coaxially between the pinion unit and the solenoid device so as to define the rest position of the pinion unit, the stopper having a tongue projecting radially outwardly from an outer periphery thereof; wherein the shoulder surface of the cover member is formed with a recess for receiving the tongue of the stopper, the recess and the tongue being dimensioned with respect to each other so as to allow the tongue to be resiliently interposed between the recessed part of the shoulder surface and the first end surface of the solenoid device and to define a space which accommodates a corresponding deformation of the tongue.

Thus, since a space which accommodates the deformation of the tongue of the stopper is provided within the recess of the shoulder surface, the tongue can be resiliently deformed so as to support the stopper steadily without affecting the axial position of the solenoid device. Because the tongue is resiliently interposed between the recessed part of the shoulder surface and the first end surface of the solenoid device, the stopper can be supported steadily for an extended period of time even though the tongue or the recessed part of the shoulder surface wears down by friction.

In view of easiness in adjusting the resiliency of the tongue, it is preferable if the deformation of the tongue essentially consists of a bending deformation.

The tongue is preferably dimensioned such that the tongue is received in the recess of the shoulder surface substantially without any circumferential play. In this way, it is ensured that the stopper is fixed in the rotational direction about the output shaft.

In one preferred embodiment of the present invention, the tongue comprises a pair of side walls and an end wall extending across axial ends of the side walls, the end wall being provided with an axial projection which is adapted to abut one of the recessed part of the shoulder surface and the first end surface of the solenoid device. In this fashion, the pair of side walls function to fix the stopper in the rotational direction, while the end wall provided with the axial projection gives a sufficient resiliency to the tongue. Further, the space for accommodating the deformation of the end wall is favorably provided between the pair of side walls. Alternatively or in addition, the tongue may comprise a resilient curved wall having a convex surface which is adapted to abut one of the recessed part of the shoulder surface and the first end surface of the solenoid device.

BRIEF DESCRIPTION OF THE DRAWINGS

Now the present invention is described in the following with reference to the appended drawings, in which.

DETAILED DESCRIPTION OF THE PREFERRED EMBODIMENTS

Figure 1:
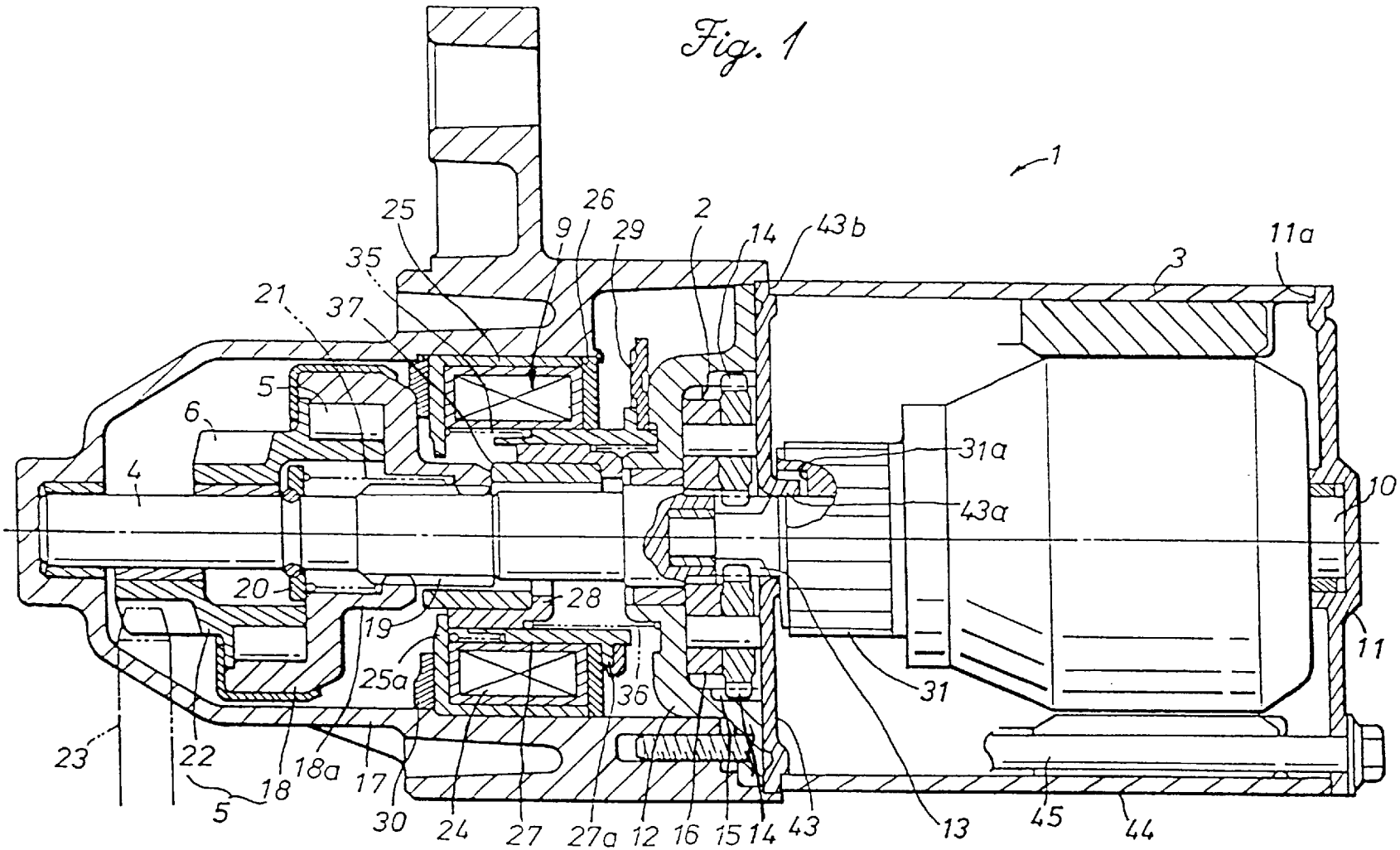
FIG. 1 is an overall view of an engine starter configured according to the present invention.

FIG. 1 generally illustrates an engine starter equipped with a reduction gear unit which is constructed according to the present invention, and the upper half of the drawing illustrates the starter at its inoperative state while the lower half of the drawing illustrates the starter at its operative state. This starter 1 produces a torque which is necessary for starting an internal combustion engine, and comprises an electric motor 3 equipped with a planetary gear reduction gear unit 2, an output shaft 4 connected to the electric motor 3 via the reduction gear unit 2, a one-way roller clutch 5 and a pinion 6 which are slidably mounted on the output shaft 4, a switch unit (not shown in the drawings) for selectively opening and closing the electric power line leading to the electric motor 3, and a solenoid device 9 for axially moving a moveable contact (not shown in the drawings) of the switch unit as well as the pinion 6.

The electric motor 3 consists of a known commutator type DC electric motor, and its rotor shaft 10 is pivotally supported at a center of a bottom plate 11 at its right end, and pivotally supported at a center of a right end of the output shaft 4, which is coaxially disposed with respect to the rotor shaft 10, at its left end.

The reduction gear unit 2 is provided on the inner surface of the top plate 12 of the electric motor 3. The reduction gear unit 2 comprises a sun gear 13 which is formed in a part of the rotor shaft 10 adjacent to the output shaft 4, a plurality of planetary gears 14 meshing with the sun gear 13, and an internal teeth ring gear 15 formed along the inner periphery of the top plate 12 to mesh with the planetary gears 14. A support plate 16 supporting the planetary gears 14 is attached to the right end of the output shaft 4 which is pivotally supported at the center of the top plate 12.

To the top plate 12 is attached a gear cover (or cover member) 17 which also serves as a securing bracket for mounting the starter to the engine. The left end of the output shaft 4 is pivotally supported by a central part of the inner surface of the left wall of the gear cover 17.

The outer circumferential surface of a middle part of the output shaft 4 engages the inner circumferential surface of a clutch outer member 18 of the one-way roller clutch 5 via a helical spline 19. The clutch outer member 18 is normally urged to the right by a return spring 21 interposed between a connecting portion 18*a* of the helical spline 19 to the output shaft 4 and a stopper plate 20 secured to a left end portion of the output shaft 4. The return spring 21 is received in an annular gap defined between the inner circumferential surface of a sleeve 18*b* formed on the inner circumferential surface of the clutch outer member 18 and the outer circumferential surface of the output shaft 4.

The clutch outer member 18 engages a clutch inner member 22 of the one-way roller clutch 5 in an axially fast but rotationally free relationship. The outer circumferential surface of the left end of the clutch inner member 22 is integrally formed with the aforementioned pinion 6 which meshes with the ring gear 23 of the engine to drive the same. The clutch inner member 22 integrally formed with the pinion 6 is fitted on the left end of the output shaft 4 in a both rotationally and axially free relationship. In this way, the one-way roller clutch 5 and the pinion 6 forms a pinion unit.

In an intermediate part of the gear cover 17 is secured an energization coil 24 which surrounds the output shaft 4 made of non-magnetic material. The energization coil 24 is surrounded by a yoke which consists of an annular disk 26 and a cup-shaped holder 25 having an internal flange 25*a* surrounding the output shaft 4. In a gap defined between the inner circumferential surface of the energization coil 24 and the outer circumferential surface of the output shaft 4 is disposed an armature outer member 27 and an armature inner member 28, both made of ferromagnetic material, in a mutually coaxial and axially slidable manner. The left ends of the armature members 27 and 28 oppose the inner surface of a central part of the internal flange 25*a* of the holder 25, and the central part of the internal flange 25*a* serves as a pole for the armature members 27 and 28.

As shown in FIG. 1, the gear cover 17 comprises a smaller diameter part for accommodating the pinion unit, which comprises the one-way roller clutch 5 and the pinion 6 as mentioned above, and a larger diameter part for accommodating the solenoid device 9 comprising the energization coil 24, cup-shaped holder 25 and annular disk 26. Between the smaller and larger diameter parts of the gear cover 17 is defined an annular shoulder surface 17*b* (best seen in FIG. 3) which abuts the axial end surface of the solenoid device 9 (more specifically, the left end surface of the holder 25) to determine the axial position of the solenoid device 9.

Figure 2:
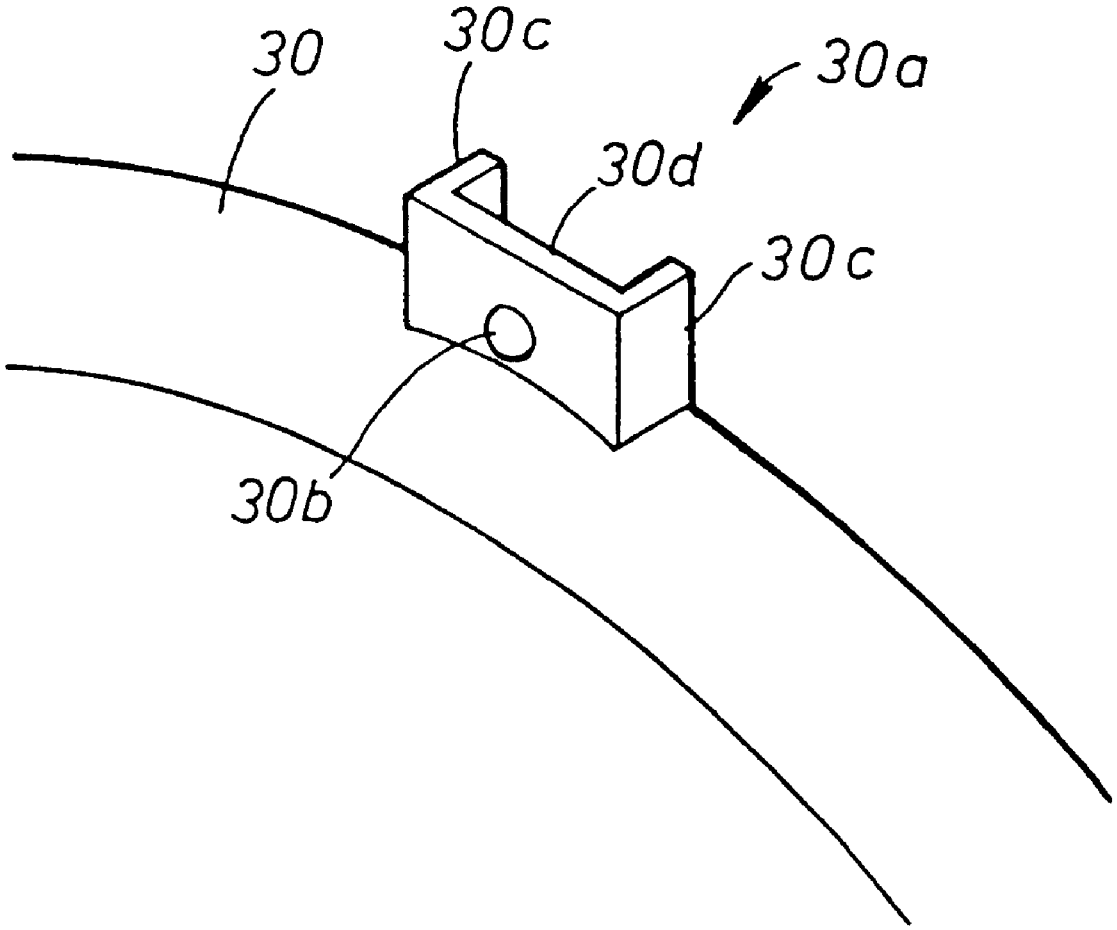
FIG. 2 is a perspective view showing a tongue formed on an outer periphery of a stopper according to the present invention.
Figure 3:
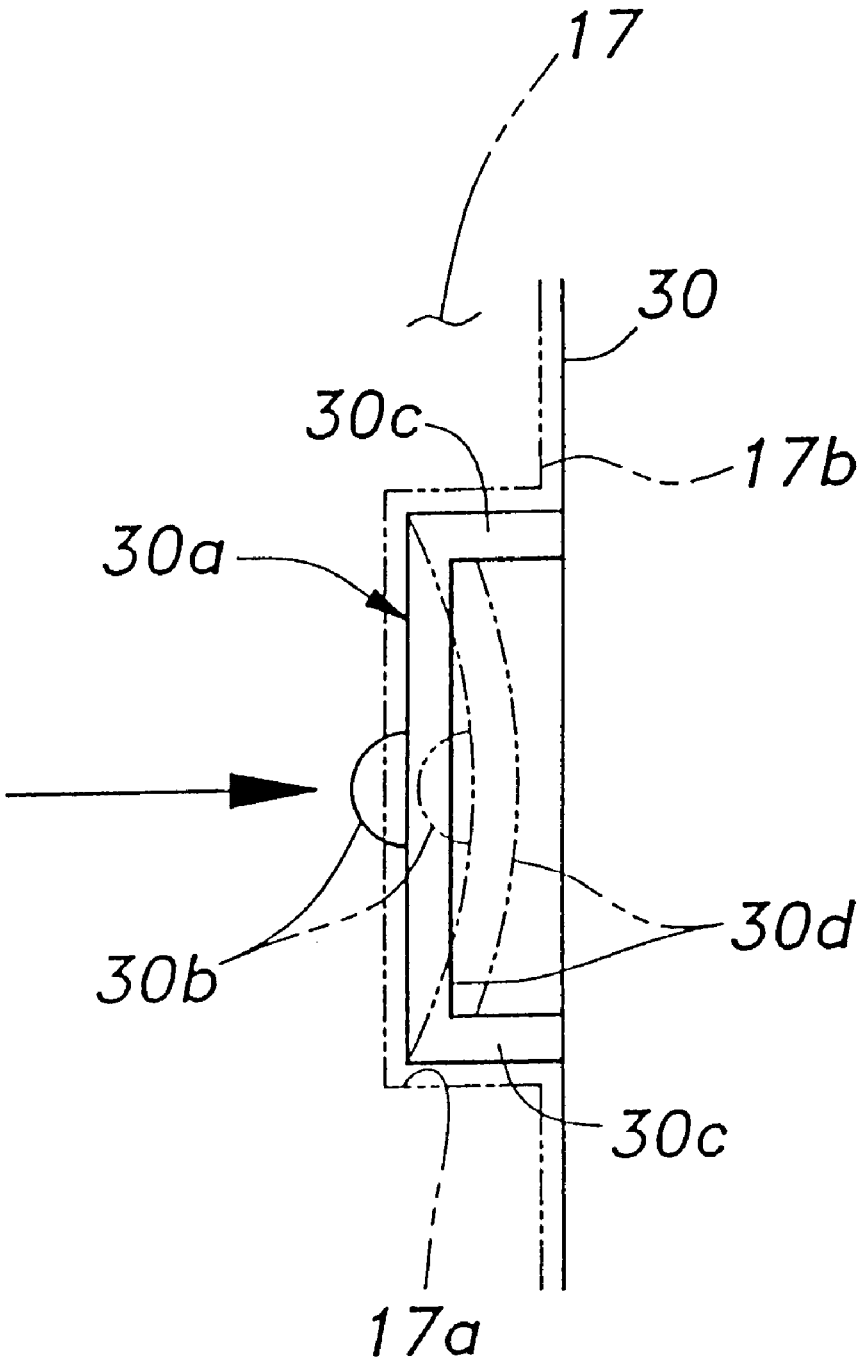
FIG. 3 is a schematic diagram showing the tongue in FIG. 2 seen in the radial direction for explaining the operation of the tongue.
Figure 4:
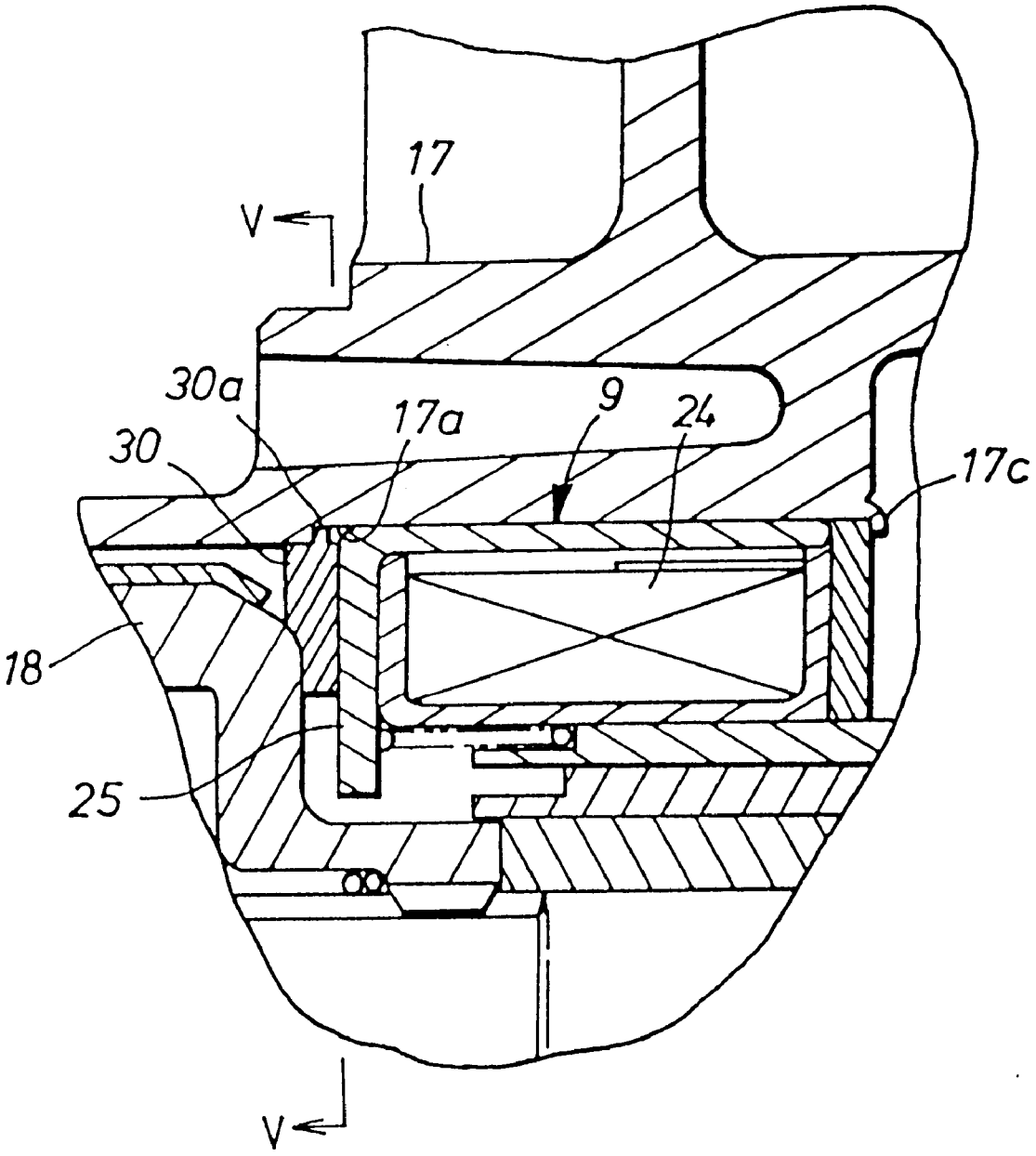
FIG. 4 is an enlarged partial view of FIG. 1 for showing the essential parts of the stopper.
Figure 5:
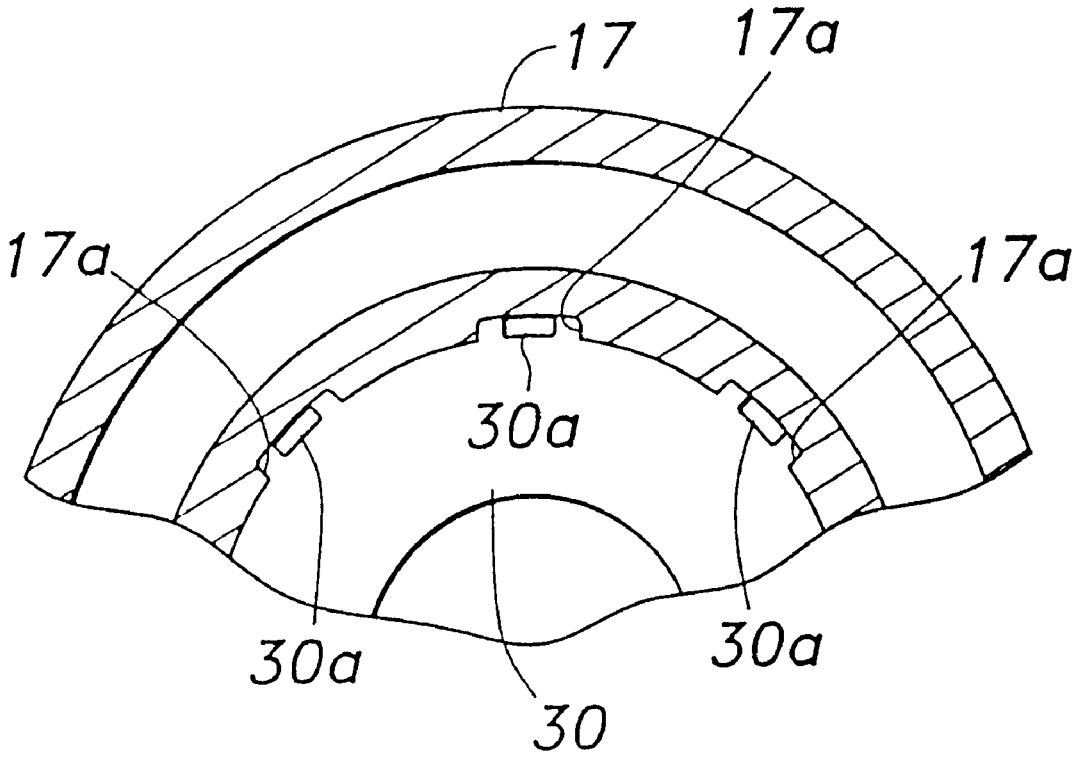
FIG. 5 is a partial sectional view taken along the line V—V in FIG. 4, showing an end surface of the stopper mounted in the gear cover.

To prevent the right end surface of the pinion unit from abutting the left end surface of the holder 25 when the pinion unit axially moves back to its rest position, an annular stopper 30 which can be made of resin material is interposed therebetween. As clearly shown in FIGS. 2–5, the stopper 30 is provided on its outer peripheral surface with a plurality of tongues 30*a* projecting radially outwardly. On the surface of each tongue 30*a* which faces the clutch outer member 18 is formed a projection 30*b*. Further, each tongue 30*a* is hollowed on its side opposite to that on which the projection 30*b* is formed. More specifically, as shown in FIGS. 2, 3 and 5, each tongue 30*a* consists of a pair of side walls 30*c* and one end wall 30*d* extending between the axial ends of the pair of side walls 30*c* so that each tongue 30*a* has a "[" shape when viewed in the radial direction. In this way, as described in detail later, each tongue 30*a* is provided with sufficient axial resiliency, and further a space is formed between the side walls 30*c* so as to accommodate a deformation of the end wall 30*d*. The annular shoulder surface 17*b* in the gear cover 17 is formed with a plurality of recesses 17*a* which are aligned with the tongues 30*a* to receive the same.

In an assembly process, the stopper 30, which, preferably, also serves to fix the solenoid device 9 in the rotational direction, is first inserted into the gear cover 17 from the right hand side in FIG. 1 so that the tongues 30*a* are received in the corresponding recesses 17*a*. Subsequently the solenoid device 9 is forced into the gear cover 17 until the end surface of the holder 25 abuts the annular shoulder surface 17*b* formed in the inner periphery of the gear cover 17. After this, parts of the edge of the gear cover 17 around the annular disk 26 are crimped to make engagement projections 17*c* (FIG. 4) which engage peripheral part of the end surface of the annular disk 26. These engagement projections 17*c* and the annular shoulder surface 17*b* serve to hold the solenoid device 9 therebetween so as to fixedly mount it inside the gear cover 17. The stopper 30 is mounted in a manner that each of the tongues 30*a* is resiliently interposed between the corresponding recessed part of the shoulder surface 17*b* and the end surface of the holder 25. More specifically, as shown by the phantom line in FIG. 3, which is schematic and not to scale, the axial projection 30*b* on each tongue 30*a* abuts on and is pressed by the corresponding recessed part of the shoulder surface 17*b*, causing the end wall 30*d* of the tongue 30*a* to be deformed resiliently. It should be appreciated that the deformation of the end wall 30*d* of the tongue 30*a* is allowed by the provision of the space defined between the pair of side walls 30*c* of the tongue 30*a*. It is preferable that the deformation of the tongue 30*a* essentially consists of a bending deformation such as that of the end wall 30*d* as shown above, because the resiliency of the tongue 30*a* can be adjusted relatively easily by changing the thickness of the end wall 30*d* with relatively little dependence on the material of which the tongue 30*a* is made, although the deformation of the tongue 30*a* may comprise a compression of the tongue 30*a*. Thus the stopper 30 is supported resiliently in the axial direction, and no play will be created even if the stopper 30 has some deviation in size from the standard one or the projection 30*b* on the tongue 30*a* wears down to some extent by friction. The axial position of the solenoid device 9 is precisely determined by the shoulder surface 17*b* of the gear cover 17, and thus the solenoid device 9 can demonstrate its required performance. As also seen in FIG. 3, each tongue 30*a* is received in the corresponding recess 17*a* substantially without any circumferential play so as to fix the stopper 30 in the rotational direction.

The right end of the armature outer member 27 is connected to the switch unit (not shown in the drawings) provided near a commutator 31 of the electric motor 3. The armature outer member 27 is always urged to the right by a return spring 35 interposed between the armature outer member 27 and the internal flange 25*a* of the holder 25 for the energization coil 24, but is normally at its neutral position separating the moveable and fixed contact plates from each other.

The armature inner member 28 is always urged to the left with respect to the top plate 12 by a coil spring 36 which is weaker that the return spring 21 of the clutch outer member 18. The armature inner member 28 is connected to a shifter member 37 made of non-magnetic material having a left end engaging the right end of the clutch outer member 18. The energization coil 24 is electrically connected to an ignition switch not shown in the drawing.

An annular metallic separator 43 is interposed between the top plate 12 and the commutator 31 to separate the reduction gear unit 2 from the electric motor 3. A central part of the separator 43 is provided with a cylindrical portion 43*a* which projects toward the commutator 31 with its inner circumferential surface receiving the outer circumferential surface of the rotor shaft 10 defining a small gap therebetween. The free end of the cylindrical portion 43*a* is received in a recess 31*a* formed in an axial end surface of the commutator 31 to prevent grease from leaking out of the reduction gear unit 2 to the commutator 31.

The bottom plate 11 is connected to the gear cover 17 by means of a through-bolt 45 via a yoke 44 for the electric motor 3 and the separator 43. As shown in FIG. 1, the right end of the yoke 44 is fitted on spigot-joint parts 11*a* of the bottom plate 11 with its inner surface and end surface engaging the bottom plate 11, while the left end of the yoke 44 is, in spite of being directly connected to the gear cover 17, fitted on spigot-joint parts 43*b* formed on the separator 43 with its inner surface and end surface engaging the separator 43. Thus the outer surface of the yoke 44 is only exposed to outside and does not engage other component parts, and therefore is allowed to be formed with lower precision. This can lead to easier manufacture of the yoke 44.

Now the operation of the above shown engine starter is described in the following. In the inoperative condition, because no electric current is supplied to the energization coil 24, the armature outer member 27 is at its rightmost condition under the spring force of the return spring 35, and the moveable contact plate (not shown) which is connected to the armature outer member 27 is spaced from the fixed contact plate (not shown). At the same time, the clutch outer member 18 which is urged by the return spring 21 is at its rightmost position along with the clutch inner member 22 which is integral with the pinion 6, the shifter member 37 and the armature inner member 28 with the result that the pinion 6 is disengaged from the ring gear 23.

When the ignition switch is turned to the engine start position, electric current is supplied to the energization coil 24 to magnetize the same. At this point, the clutch outer member 18 which is made of ferromagnetic material abuts the stopper 30, but because the stopper 30 is made of non-magnetic resin material, the leakage of magnetic flux from the holder 25 to the clutch outer member 18 is very little. Once the energization coil 24 is magnetized, a magnetic path for conducting a magnetic flux is established in the armature inner and outer members 27 and 28 thereby moving the armature inner and outer members 27 and 28 to the left. The armature outer member 27, as it is closer to the central part (pole) of the internal flange 25*a* of the holder 25 than the armature inner member 28, moves before the armature inner member 28. As a result, although not shown in the drawings, the moveable contact plate which is attached to the armature outer member 27 and to which pig tails of the brushes of the electric motor 3 are connected moves to come into contact with the fixed contact plate connected to the battery. This in turn causes the electric power of the battery to be supplied to the electric motor 3, and the rotor shaft 10 to be turned.

The armature outer member 27 comes to a stop with a certain gap defined between the left end surface of the armature outer member 27 and the central part of the internal flange 25*a* as an external flange 27*a* integrally formed at the right end of the armature outer member 27 comes into contact with the annular disk 26.

As the rotor shaft 10 turns, this rotation is reduced in speed by the reduction gear unit 2, and is transmitted to the output shaft 4. Because of the inertia of the clutch outer member 18 which engages with the output shaft 4 via the helical spline 19, the axial force owing to the helical spline 19 is applied to the clutch outer member 18, causing it to move to the left. At the same time, the armature inner member 28, which is subjected to the leftward attractive force by the energization coil 24 and the pressure from the coil spring 36, starts moving to the left. This force is applied to the clutch outer member 18 as an axial force via the shifter member 37.

This axial force pushes the clutch outer member 18 leftward against the biasing force of the return spring 21, and the pinion 6, which is integral with the clutch inner member 22 and is therefore integrally engaged with the clutch outer member 18, is also pushed leftward. Once the clutch outer member 18 engages with the stopper plate 20, and the pinion 6 comes into full mesh with the ring gear 23, the rotation of the output shaft 4 is transmitted to the ring gear 23, and starts the engine. At this point, the left end surface of the armature inner member 28 engages the central part of the internal flange 25*a* of the holder 25, and a small gap is defined between the left end surface of the shifter member 37 which has integrally moved with the armature inner member 28 and the clutch outer member 18. Because the armature inner member 28 receives a maximum attractive force of the energization coil 24 as it engages the central part of the internal flange 25*a* of the holder 25, even when the pinion 6 is subjected to a force which tends to disengage it from the ring gear 23, the rightward movement of the clutch outer member 18 is prevented by the shifter member 37, and the pinion 6 is prevented from dislodging from the ring gear 23.

The electric current that is required to keep the armature inner and outer members 27 and 28 stationary after they have moved the full stroke is substantially smaller than that required for starting the movement of the armature inner and outer members 27 and 28. In other words, by making use of the axial force owing to the helical spline 19 for starting the movement of the one-way roller clutch 5 including the pinion 6, the output requirement of the energization coil 24 can be reduced, and the size of the energization coil 24 can be accordingly reduced. Once the engine has started and the rotational speed of the engine exceeds that of the pinion 6, the pinion 6 will start turning freely by virtue of the one-way roller clutch 5 in the same manner as in the conventional engine starter.

When the supply of electric current to the energization coil 24 ceases, owing to the biasing force of the return spring 21 acting upon the clutch outer member 18 and the biasing force of the return spring 35 acting upon the armature outer member 27, the pinion 6 is disengaged from the ring gear 23 and the moveable contact plate is separated from the fixed contact plate, thereby stopping the electric motor 3.

As described above, in an engine starter according to the present invention, an annular stopper disposed between the pinion unit and the solenoid device so as to determine the rest position of the pinion unit is formed with a tongue projecting radially outwardly from its outer periphery, and a shoulder surface defined in the gear cover so as to abut an end surface of the solenoid device and thereby determine the axial position of the solenoid device is formed with a recess for receiving the tongue of the annular stopper, with the tongue and the recess being dimensioned with respect to each other so as to allow the tongue to be resiliently interposed between the recessed part of the shoulder surface and the end surface of the solenoid device and to define a space which accommodates a corresponding deformation of the tongue. Thus, since a space which accommodates the deformation of the tongue of the stopper is provided within the recess of the shoulder surface, the tongue can be resiliently deformed so as to support the stopper steadily without affecting the axial position of the solenoid device.

Although the present invention has been described in terms of preferred embodiments thereof, it is obvious to a person skilled in the art that various alterations and modifications are possible without departing from the scope of the present invention which is set forth in the appended claims. For example, although in the illustrated embodiment the axial projection provided on the end wall of the tongue was adapted so as to abut the recessed part of the shoulder surface and cause the end wall to bend toward the solenoid device, the axial projection and the bending end wall of the tongue can be formed on the side facing the solenoid device. It is also conceivable to form the tongue without the side walls although the tongue having the side walls may be preferable in view of securing the stopper member in the radial direction. Further, the tongue can be formed to have a resilient curved wall having a convex surface which is adapted to abut the recessed part of the shoulder surface. Such a tongue may have a generally "C" shaped, circular or elliptic cross section when viewed in the radial direction.

What we claim is:

1. A starter for an internal combustion engine, comprising:

a DC electric motor;

an output shaft driven by the DC electric motor;

a pinion unit connected to the output shaft via a spline and moved axially between a rest position and an operative position in which the pinion unit meshes with a ring gear of the engine;

a solenoid device for axially moving the pinion unit from its rest position to its operative position, the solenoid device disposed between the pinion unit and the DC electric motor and surrounding the output shaft, and the solenoid device having a first end surface facing the pinion unit and a second end surface facing the DC electric motor;

a cover member having a substantially cylindrical inner surface for surrounding at least the pinion unit and the solenoid device, the cover member comprising a first part having a first inner diameter and accommodating the pinion unit and a second part having a second inner diameter which is larger than the first inner diameter and accommodating the solenoid device, with an annular shoulder surface defined at a boundary between the first and second parts, the shoulder surface abutting the first end surface of the solenoid device to determine an axial position of the solenoid device; and an annular stopper disposed coaxially between the pinion unit and the solenoid device so as to define the rest position of the pinion unit, the stopper having a tongue projecting radially outwardly from an outer periphery thereof;

wherein the shoulder surface of the cover member is formed with a recess for receiving the tongue of the stopper, the recess and the tongue being dimensioned with respect to each other so as to allow the tongue to be resiliently interposed between the recessed part of the shoulder surface and the first end surface of the solenoid device and to define a space which accommodates a corresponding deformation of the tongue.

2. A starter for an internal combustion engine according to claim 1, wherein the deformation of the tongue essentially consists of a bending deformation.

3. A starter for an internal combustion engine according to claim 1, wherein the tongue is dimensioned such that the tongue is received in the recess of the shoulder surface substantially without any circumferential play.

4. A starter for an internal combustion engine according to claim 3, wherein the tongue comprises a pair of side walls and an end wall extending across axial ends of the side walls, the end wall being provided with an axial projection which is adapted to abut one of the recessed part of the shoulder surface and the first end surface of the solenoid device.

5. A starter for an internal combustion engine according to claim 3, wherein the tongue comprises a resilient curved wall having a convex surface which is adapted to abut one of the recessed part of the shoulder surface and the first end surface of the solenoid device.

* * * * *